United States Patent [19]

Sandrow

[11] Patent Number: 4,964,358

[45] Date of Patent: Oct. 23, 1990

[54] SMALL BOAT HOISTING APPARATUS AND METHOD

[76] Inventor: Martin S. Sandrow, 76 C Elizabeth Ave., Somerset, N.J. 08873

[21] Appl. No.: 327,293

[22] Filed: Mar. 22, 1989

[51] Int. Cl.[5] ..... B63B 23/02

[52] U.S. Cl. ..... 114/368; 114/365

[58] Field of Search ..... 114/230, 365, 366, 368, 114/375, 258–260, 44

[56] References Cited

U.S. PATENT DOCUMENTS

| | | | |
|---|---|---|---|
| 1,069,905 | 8/1913 | Scott | 114/366 |
| 1,152,181 | 8/1915 | Katko | 114/366 |
| 2,091,327 | 8/1937 | McPartland | 114/366 |
| 2,294,864 | 9/1942 | Palmer | 114/368 |
| 2,349,268 | 5/1944 | Hartzog | 114/365 |
| 2,398,274 | 4/1946 | Albert | 114/259 |
| 3,143,991 | 8/1964 | Anderson | 114/365 |
| 3,596,623 | 8/1971 | Frankel | 114/259 |
| 4,627,377 | 12/1986 | Zoonens | 114/365 |

*Primary Examiner*—Joseph F. Peters, Jr.
*Assistant Examiner*—Edwin L. Swinehart
*Attorney, Agent, or Firm*—Arthur J. Plantamura

[57] ABSTRACT

A small boat or dinghy rigging mechanism is provided advantageously designed to permit the expeditious recovery, hoisting and stowing of a small boat or dinghy in an upright position at the stern of a main vessel. The apparatus of the invention is devised to be readily detached from the main vessel and stowed so that any unsightly presence of the equipment when it is not being used is obviated. The rigger equipment may be detachably affixed for use directly on the transom of a vessel or adapted to be detachably secured at the trailing edge of a platform such as swim platform that is behind the transom. Because the mechanism is devised to dip into the water allowing the small boat or dinghy to be floated into position on the arms of the rigging apparatus, it substantially facilitates the recovery of such craft and obviates any heavy lifting or exertion of the kind frequently encountered by a user in operations of this kind. Also because the dinghy or small boat is recovered while being maintained upright, is supported underneath, stored at the stern of the main vessel and secured in an upright position, the outboard motor or other depending propulsion or steering equipment need not be removed from the dinghy or small craft in order to recover and stow the small craft on the main vessel.

5 Claims, 4 Drawing Sheets

SMALL BOAT HOISTING APPARATUS AND METHOD

This invention relates to small boat handling and stowing apparatus and, more particularly to a rigging mechanism secured to a larger vessel for the purpose of raising onto the vessel from the water and stowing thereon, and for lanching from the vessel, a smaller boat or dinghy.

BACKGROUND OF THE INVENTION

Various arrangements exist, and others have been proposed, for use on a vessel for the purpose of stowing thereon, and launching therefrom, a relatively smaller auxialiary boat, also referred to as a dinghy, which is often carried on the relatively larger vessel as a tender or lifeboat.

The small boat or dinghy is often equipped with a motorized propulsion means, such as an outboard motor which usually, in connection with the nature of the hoisting apparatus, requires removal of the motor, before the dinghy can be raised and stowed onto the main vessel. This can be a time-consuming and burdensome task.

Prior art small boat or dinghy rigging apparatus also involve turning, i.e., rotating, the recovered small craft on its side for stowing on the vessel, a practice which is inconvenient and at times awkward, obscures the view aft from the vessel, and is relatively unsightly.

Additionally, when the dinghy or smaller craft is not on the main vessel, most prior art systems require a relatively permanent installation of the rigging mechanism on the main vessel; such installations being especially unsightly when not in use; they lack versatility, and are relatively expensive.

SUMMARY OF THE INVENTION

It is an object of the present invention to provide a novel apparatus for rapidly and easily hoisting and launching a dinghy (small shore craft) relative to a larger vessel.

It is a further and more particular object of the invention to provide an apparatus of this kind which avoids the cumbersome and sometimes perilous task of removing the outboard motor from the dinghy prior to hoisting the dinghy on to the main vessel or when the vessel in traveling with the dinghy on board.

It is another object of the invention to provide a rigging apparatus for recovering a small boat or dinghy and securing the craft thus recovered on the main vessel in an upright position and without the necessity of removing the outboard motor from craft equipped with such motors.

It is still another object of the invention to provide a novel dinghy rigging apparatus which has relatively broad application in that it is suitable for securing on the vertical exterior bulk head of at the stern of the vessel or, alternatively, for securing on a swim platform which may be present at the stern of the vessel.

It is a further object of the invention to provide a novel dinghy rigging apparatus which is easily secured at the stern of a vessel and yet is readily detachable and stored when desired, thereby obviating the presence of any aesthetically unsightly equipment at the rear of the vessel.

Additional objects and advantages of the invention will become apparent when considered in conjunction with the figures of the accompanying drawing of which the following is a brief description.

DETAILED DESCRIPTION OF THE INVENTION

Figure 1:
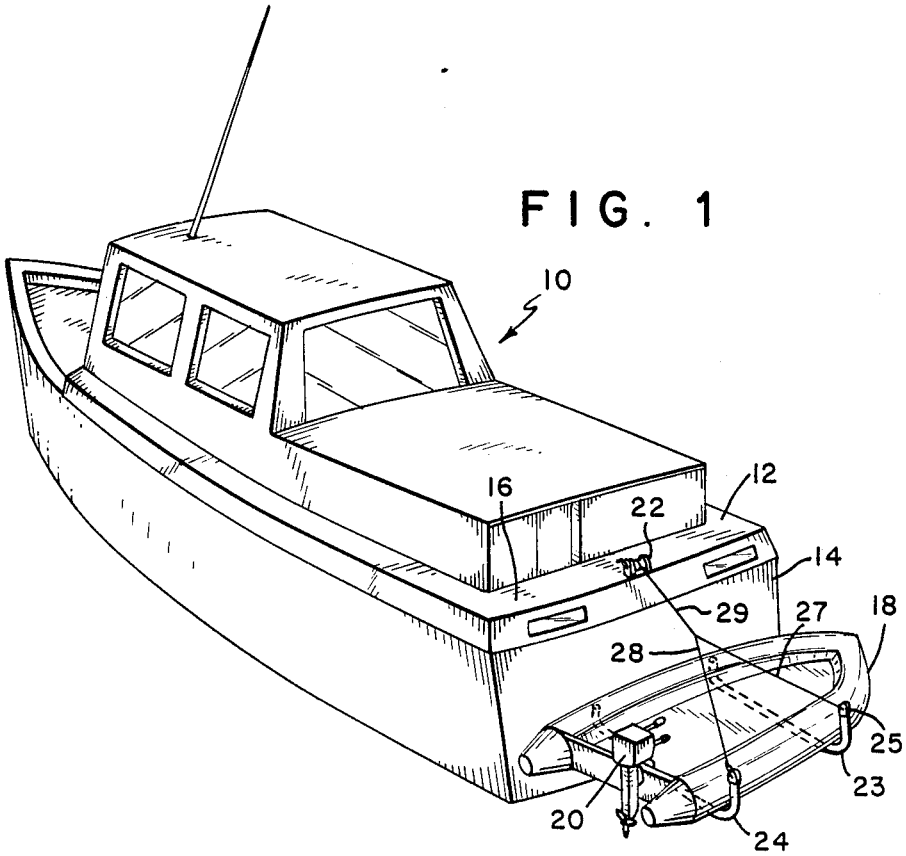
FIG. 1 is a perseptive illustration of a main vessel showing a dinghy in a stowed position at the stern of the vessel.

The novel dinghy rigging apparatus of the invention is advantageously designed to more easily secure a small craft or dinghy on a vessel. The launching and recovery of a small craft with the rigging apparatus of the invention is assisted by the buoying effect of the water i.e., which in use functions by substantially floating the dinghy onto the rigging apparatus that has been pivoted toward and is partially disposed in the water, and securing the dinghy for lifting out of the water and into a horizontal stowed position. Similarly, in launching the dinghy from the stowed horizontal position, the rigger arms supporting the dinghy are pivoted toward and are partially immersed in the water until the weight of the dinghy is substantially buoyed by the water when the rigging apparatus is disengaged.

The support of the small craft or boat or tender, names which are used interchangeably with the term "dinghy", from underneath and the stowage thereof on the vessel in a substantially horizontal disposition, in accordance with the dinghy rigging system of the present invention, affords distinct advantages not heretofore available in any known apparatus for effecting this function.

Referring to the form of the invention illustrated at FIGS. 1 through 4A of the drawing, the rigging arms or apparatus extend co-linearly with the vessel keel and is removably secured by brackets 40 to the exterior of the vertical transom 14 which is normally secured to, and supported by, the sternpost of a vessel 10.

As seen by reference to FIG. 1, a relatively large vessel 10 comprising generally a cabin compartment 12, a substantially vertical stern transom 14 and a deck portion 16, is shown with a dinghy 18 secured at the rear of the vessel 10. The rigging apparatus for the dinghy 18 shown in FIG. 1, and comprising the mechanism of the invention, will be best seen by reference to FIG. 2 through 4A which show the elements of the rigging apparatus in greater detail.

Figure 2:
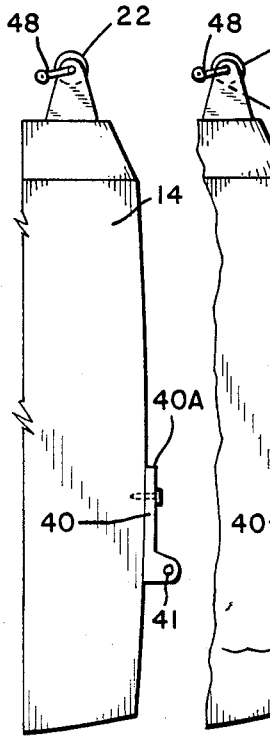
FIG. 2 is a fragmentary view of a stern portion of a vessel illustrating a winch mechanism and a bracket for securing the dinghy rigger apparatus to the exterior vertical bulkhead at the stern of a vessel.

Referring to FIG. 2 of the drawing, a fragment 14 of the vessel 10 is illustrated comprising the substantially vertical bulkhead or transom on which a pair of mounting brackets 40 is mounted and on which pivotable rigger arms 23 and 24 are preferably removably attached such as by pins inserted into opening 41 in the bracket 40. The bracket 40 is shown as having a generally L-shape cross section comprising a vertical leg portion 40A and a horizontal portion 40B between which the corner of the arms 23 and 24 is inserted and through which a securing pin 44 is inserted to hold the arms in pivotal relationship in the brackets 40. A conventional winch 22, shown with a hand crank 48, is suitably mounted on vessel to pivotally activate the rigger arms which are connected to winch 22 through a line or cable 29. The cable 29 conveniently divides into a Y-form (see FIG. 1) to provide the cable arms 27 and 28 which, at the remote ends thereof, are suitably connected to the remote ends of arms 23 and 24 such as by way of eye-shaped openings 25 formed at the ends of arms 23 and 24.

Figure 2A:
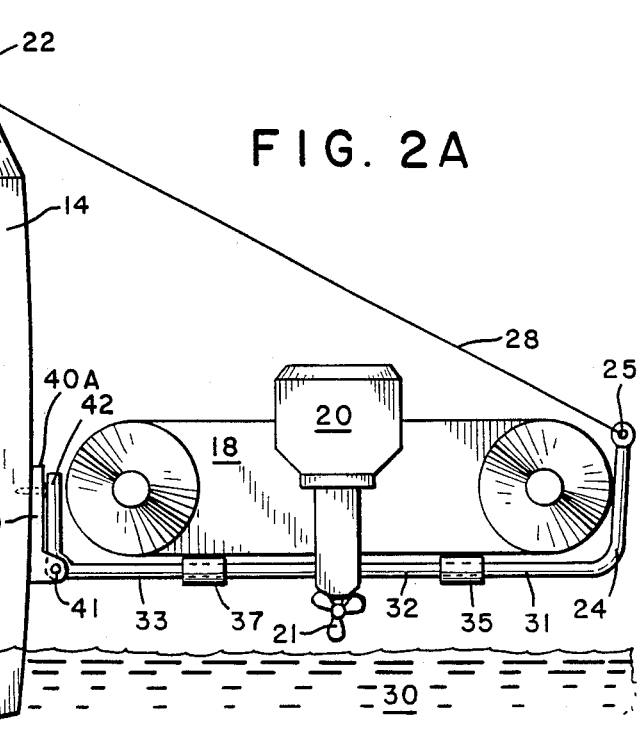
FIG. 2A is a side elevational view of the dinghy rigger apparatus secured on the bracket illustrated in FIG. 2 with a dinghy housed in elevated position thereon.
Figure 3:
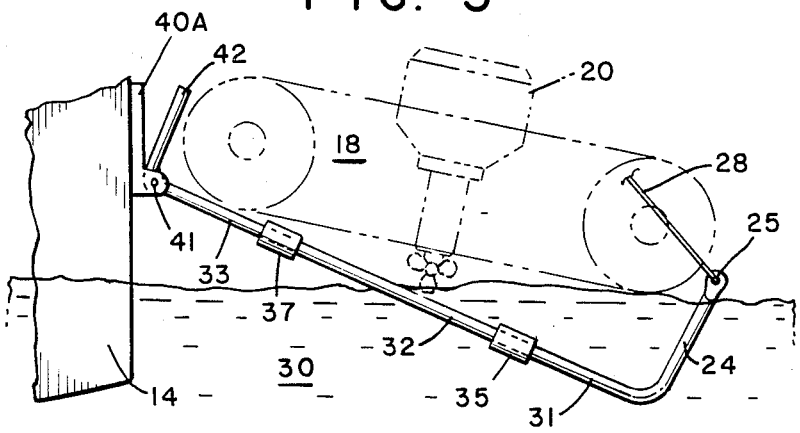
FIG. 3 is a fragmentary elevational view showing the dinghy rigging apparatus illustrated in FIG. 2A pivotally lowered partially into the water and the dinghy in broken line and partially buoyed in the water.
Figure 4:
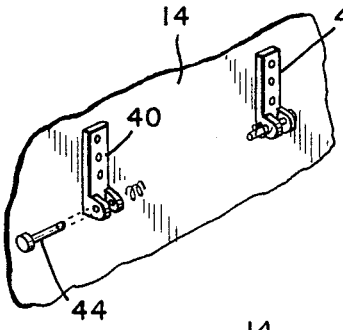
FIG. 4 is a perspective illustration of the dinghy rigger brackets, also shown in FIG. 2 and affixed to a fragmentary portion of the vertical vessel stern.
Figure 4A:
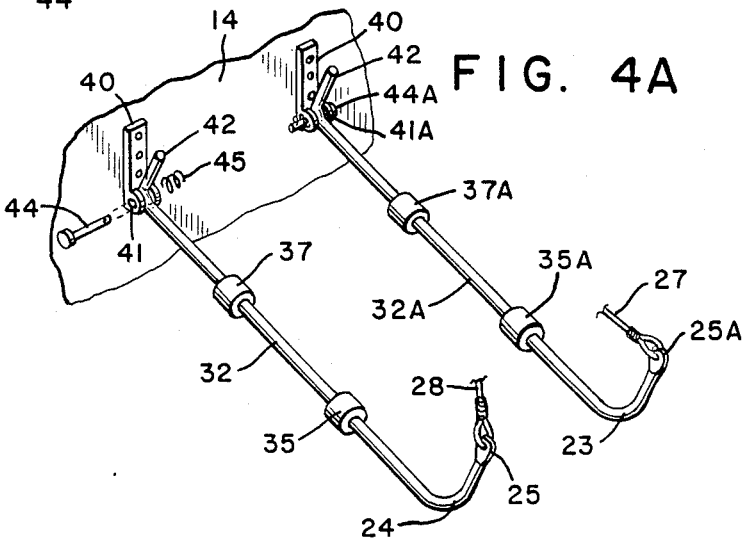
FIG. 4A illustrates the dinghy rigging apparatus attached to the brackets shown in FIG. 4.

As best seen in FIGS. 2A, 3 and 4A, the dinghy rigger apparatus of the invention comprises a pair of arms 23 and 24, which are pivotally, and in a preferred embodiment removably, secured on brackets 40 that are mounted on the vessel transom 14. The arms 23 and 24 have a contour or shape to accomodate the dinghy and may conveniently comprise a shallow U-shaped form, i.e., a cross section, with a pivot mounting point for the arms being provided at the corner of the vertical leg 42 and the horizontal segment 33 of such U-shaped arm that is contiguous to the pivot point mount. The top of vertical leg of the arm 24 that is remote from the pivot point, is provided with suitable means, shown as 25, to secure the ends of the lifting cable 27 and 28, respectively, to the arms 23 and 24. The arms 23 and 24 are illustrated as comprising arm portions 31, 32 and 33, but may be formed as an integral one-piece arm and may include roller elements 35 and 37 and 35A and 37A, respectively, to facilitate movement of the dinghy when it is resting on the arms. The arms may also include a telescoping section, or other arm length adjusting means, to accommodate for dinghy beams of varying sizes. As shown in FIG. 2A, the dinghy rigger brackets 40 are positioned on the vessel transom 14 at an elevation on the transom such that when the rigger arms 23 and 24 are in the elevated, i.e., disposed horizontally, a position attained when the vertical leg 42 of the rigger arm engages the face of the vertical leg 40A of bracket 40, the dinghy 18 is then supported underneath by arms 23 and 24 sufficiently clear of the water surface 30. Such clearance should include that necessary for a depending outboard motor impeller 21 when a dinghy is equipped with a motor 20. The rigger arms 23 and 24 are preferably pivotally secured at the point 41 by quick connect-/disconnect type securing means and locks 44 and 45 to permit ready detachment of the rigger arms from the vessel. In describing the arms 23 and 24, reference numerals accompanied by the letter "A" with respect to arm 23, perform functionally in a manner similar to the corresponding numerical refer numbers applied to elements referring to arm 24.

As seen by reference to FIG. 3 when a dinghy is to be hoisted from the water, the rigger arms 23 and 24 are lowered sufficiently to permit the dinghy to be floated within the confines of these U-shaped arms; manuevered into a suitable transverse location on the arms so that the dinghy is in a reasonably balanced position on the arms, with suitable clearance if necessary for an outboard motor; and the small craft 18 is then hoisted into a horizontal position by manual activation at 48 of the hoist 22 which, via cables 27, 28 and 29 connected at the remote ends 25 of arms 27 and 28, elevates the rigger arms which support the dinghy from underneath until a substantially horizontal position of arms 23 and 24 is attained. A suitable supplementary locking means, not shown, to hold the arms in the horizontal position may be employed to relieve the tension on the hoisting cable. In launching the dinghy, the direction of the winch is reversed until the arms are lowered into the water and the small craft or dinghy is buoyed by the water permitting the disengagement of the dinghy from the rigging.

In the form of the invention shown in FIGS. 5 through 8, the rigging apparatus of the invention is employed in conjunction with a vessel that is equipped with a horizontal platform or deck extending rearwardly of the vessel transom, sometimes referred to as a "swim platform."

Figure 5:
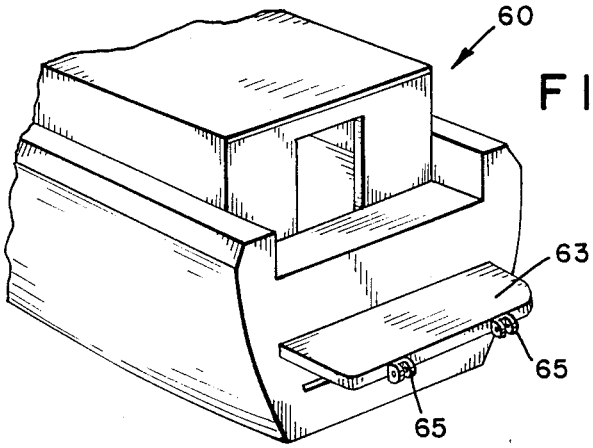
FIG. 5 is a fragmentary illustration of a vessel which differs from that of FIG. 1 in that it is provided with a rearwardly extending horizontal deck or platform at the stern of the vessel.
Figure 6:
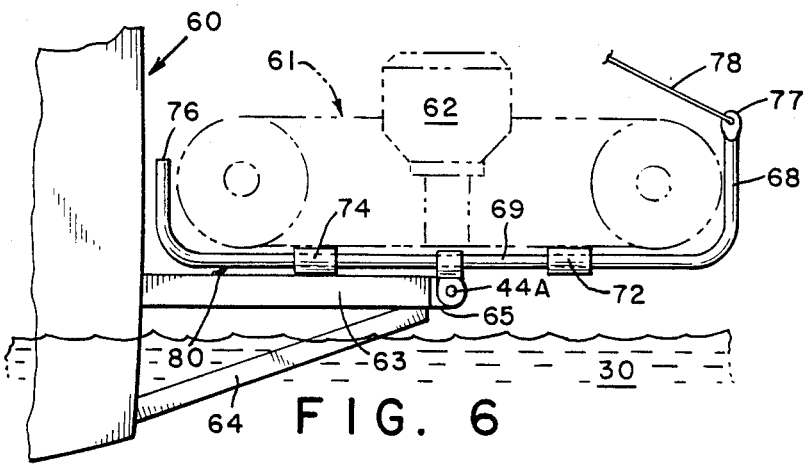
FIG. 6 illustrates schematically the dinghy rigging apparatus secured to the end of a horizontal platform of a vessel, as that of FIG. 5, equipped with such a platform and showing schematically in broken line a dinghy in position on the rigging apparatus.
Figure 7:
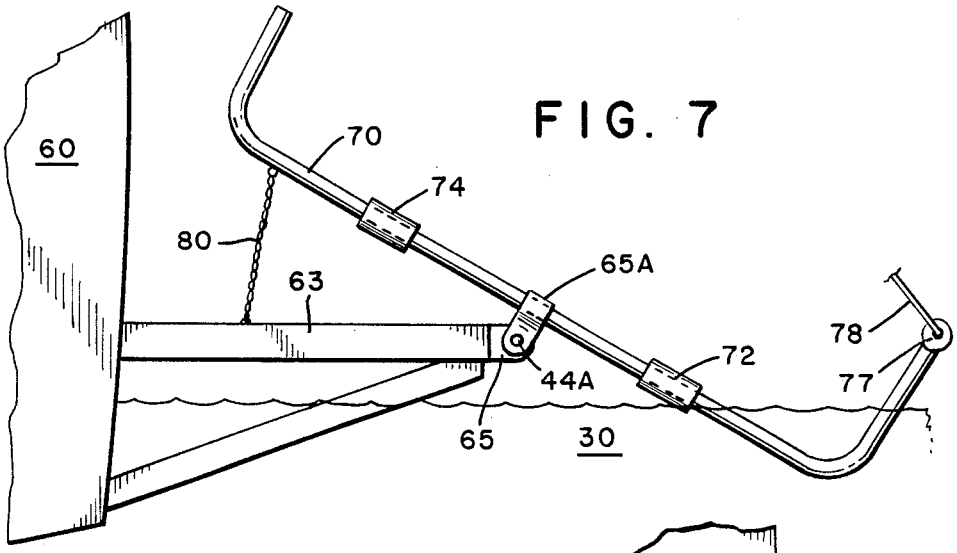
FIG. 7 illustrates rigging apparatus in a view similar to FIG. 6, except with the omission of the schematically illustrated dinghy, and wherein the dinghy supporting arms are pivotally tilted towards the water in a position tending to facilitate the securing thereon for hoisting, or the lauching therefrom, of a small craft or dinghy.

As seen by reference to FIGS. 5 and 6, the vessel, a fragment 60 of which is shown, provided with a platform 63 extending aft of vessel 60. A dinghy 61 (FIG. 6) with an outboard motor 62 attached is secured on a pair of rigger arms 69, 70. The arms 69, 70 (FIG. 8) are secured to the trailing or outboard edge of platform 63 by suitable pivotable attachment, preferably quick connect/disconnect coupling means comprising brackets 65 and removable bolts 44A. The brackets may optionally be secured as an integral unit, i.e., as shown in FIG. 8A by the brackets 65A secured to a mounting plate 65B. The pivotal connection of the arms 69, 70 on brackets 65 enable the arms 69, 70 of the rigging apparatus of the invention to tilt into the water 30 when recovering or launching the dinghy. This enables the dinghy 61 to be essentially floated onto, and off from, the rigger arms 69, 70 with minimal effort. Once the dinghy is on the rigger arms, support cable 78 is retracted, by suitable mechanism such as that referred to with reference to cable 29 in FIG. 1, securing small craft in place. In launching the supported small craft, the cable 78 is unwound permitting the arms 69 and 70 supporting the small craft, e.g., the dinghy 61, to pivot into the water.

chain segments 80, or other suitable means, function as stops to prevent the rigger arms from flipping or overturning into the water 30. Rollers 72 and 74 mounted on the arms facilitate the movement of the small craft when it is resting on the arms and especially when retrieving or launching the dinghy and the arms 69 and 70 are in the water 30. When the rigger apparatus is not in use, the dinghy rigger arms 69, 70 are readily disconnected at pivot connection 65, by removing the quick-connect/disconnect bolt 44A and the arms 69 and 70, and suitably stowing them out of the way.

Figure 8:
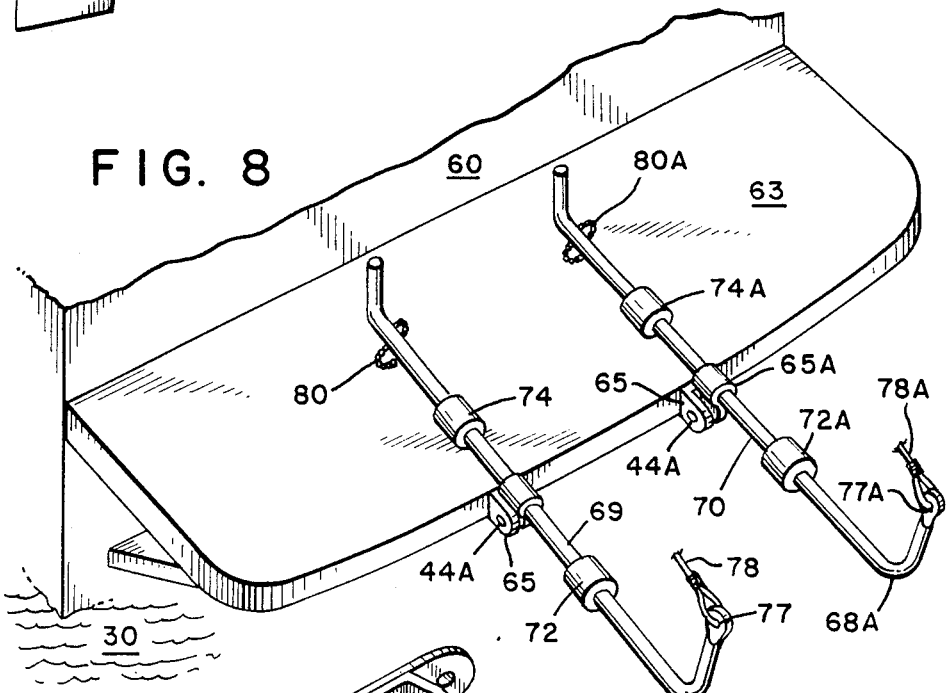
FIG. 8 illustrates the rigging apparatus pivotally secured on mounts at the trailing end of a horizontal platform that extends from the stern end of a vessel.
Figure 8B:
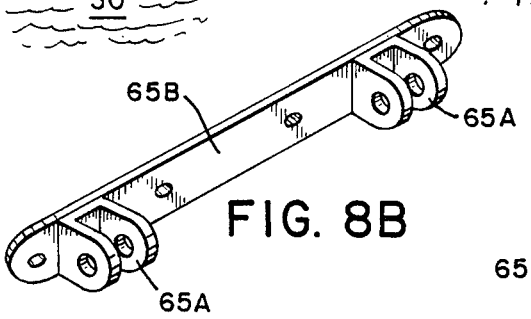
FIG. 8B illustrates an alternate form of bracket arrangement to that of FIG. 8A wherein in the bracket pair is secured to, or integrally formed as a part of, a mounting plate which is secured to the end of the horizontal platform.
Figure 8A:
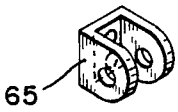
FIG. 8A is illustrated one form of a bracket similar to that in FIG. 8 in which a pair of such brackets are secured to the horizontal platform and to which the dinghy rigging apparatus is attached.

FIG. 8 is an isometric view of the vessel transom 60 having a horizontally disposed platform 63 and provides another view of the dinghy rigger arms 69 and 70 which are mounted on trailing edge of the platform 63 with quick connect/disconnect bolts 44A. A suitable stop mechanism, such as a chain segment 80 prevents the dinghy riggers arm from overturning into the water 30. When the small craft or dinghy 61 is not to be transported or stored on vessel 60, the rigger arms 69 and 70 are disconnected by removing quick-disconnect bolts 44A and the arms are stored. This permits the platform to be free for use, such as for swimming, fishing, etc. Rollers 72, 72A, 74 and 74A help to maneuver the dinghy, when it is resting on the rigger arms, relative to the rigger arms especially when retrieving or launching the dinghy on the arms 69 and 70 are rotated in and partially immersed in the water 30.

As seen by the foregoing, the rigging apparatus of the invention permits the rigger apparatus to be readily secured, in an out-of-way location; it is easily removed and installed and available for use while under way. It is to be noted, also, that the installation and use of the rigger as a general rule may be accomplished by a single individual. When the small craft has been launched or is in use, the rigger apparatus is preferably disconnected from the transom by uncoupling a suitable quick connect/disconnect mechanism and the rigger arms brought aboard for out-of-the-way storage. It will be understood, also, that the dinghy rigger of the invention is applicable to both sail and motor vessels.

It is thus seen that the novel dinghy rigging mechanism of the invention is advantageously designed to permit the expeditious recovery, hoisting and stowing of a small boat or dinghy onto a main vessel. The apparatus of the invention is devised to be readily detached from the main vessel and stowed so that any unsightly presence of the unoccupied equipment, i.e., when it is not being used, is obviated. The rigger equipment may be detachably affixed for use directly on the transom of a vessel or adapted to be detachably secured at the trailing edge of a platform such as a swim platform that is behind the transom. The rigging apparatus of the invention, because it is devised to dip into the water allowing the small boat or dinghy to be floated into position on the arms of the rigging apparatus, substantially simplifies the recover and connecting of such craft and obviates the subjecting of an operator to exertion of the kind frequently required in operations of this kind. Also because the recovered dinghy or small boat when stored on the main vessel is supported underneath and in an upright position, the outboard motor or other propulsion motor need not be removed in order to recover and stow the small craft on the main vessel.

While I have shown and described my apparatus in detail, it is to be understood that the invention is to be limited only by the appended claims inasmuch as various changes may be made without departing from the spirit and scope of the invention.

What is claimed is:

1. Rigging apparatus for securing to the aft end of a vessel, for recovery from the water and stowing on said vessel, a small craft or dinghy comprising:

(a) a pair of arms for supporting a small craft in an upright position and at the underside of the small craft, said arms extending rearwardly from the vessel in a line which is parallel to the line of the keel of said vessel, and at the stern of the vessel, and being pivotally mounted on the vessel, said arms being devised such that when one end of the arms in relation to the other end of the arms is pivoted downward from a horizontal position, one end of the arms is partially submerged in the water and when in the thus submerged position facilitate the floating directly onto said arms and securing thereon of a small craft, and (b) hoisting means on said vessel connected to said arms, at a point on said arms aft of the pivotable mounting point of said arms on the vessel, to lower the remote end of the small craft supporting arms, and to raise the arms from a thus lowered position to a horizontal stowing position for the small craft.

2. The apparatus of claim 1 wherein the arms comprise a generally U-shaped cross section and are pivotally secured at the trailing edge of a platform contained on said vessel and at a point aft of a transom on said vessel.

3. The apparaus of claim 1 wherein the pivotally attached arms are secured to the vessel by quick connect/disconnect coupling.

4. The apparatus of claim 1 wherein the arms are provided with means to facilitate the positioning of the small craft on the support arms.

5. A method of hoisting a small boat in an upright position onto a main vessel from an initially waterborne position contiguous to the stern of the vessel and storing the small boat in an upright position at the stern of the vessel, comprising:

(a) providing a pair of arms which are pivotally secured to and at the stern of the vessel for supporting the small craft at the underside of the small craft and in an upright position, (b) pivoting said arms, one end in relation to the other, downward from a horizontal position so that the end of said arms remote from the stern of the vessel is submerged in the water at the stern of said vessel, (c) floating said small craft into position on said arms when said arms are at least partially in the submerged position, and such that the small craft is retained on and supported underneath on said arms, (d) pivoting the said arms upward, one end in relation to the other, with the small craft supported in an upright position thereon and with said arms in a horizontal stowing position, and (e) securing the small craft on said vessel.

* * * * *